United States Patent [19]

Spangler et al.

[11] 4,371,229

[45] Feb. 1, 1983

[54] INTEGRAL ELECTRICAL CONNECTOR AND METHOD FOR MAKING SAME

[75] Inventors: Paul J. Spangler, Novelty; Robert C. Koslo, Mentor, both of Ohio

[73] Assignee: ETC, Incorporated, Bedford Heights, Ohio

[21] Appl. No.: 161,380

[22] Filed: Jun. 20, 1980

[51] Int. Cl.[3] ..... H01R 4/20

[52] U.S. Cl. ..... 339/223 R; 339/276 T; 29/863

[58] Field of Search ..... 174/84 C; 339/223 R, 339/276 T; 29/863, 882; 138/156, 172, 151, 140; 72/370; 228/143

[56] References Cited

U.S. PATENT DOCUMENTS

| | | | |
|---|---|---|---|
| 1,909,501 | 5/1933 | Quarnstrom | 228/143 |
| 2,014,982 | 9/1935 | Quarnstrom | 228/143 |
| 2,866,480 | 12/1958 | Snively | 228/143 |
| 3,601,783 | 8/1971 | Loose | 339/223 R |
| 3,656,092 | 4/1972 | Swengel et al. | 339/223 R |
| 4,142,771 | 3/1979 | Barnes et al. | 339/276 T |
| 4,229,063 | 10/1980 | Yoshizawa | 339/276 T |

*Primary Examiner*—John McQuade

*Attorney, Agent, or Firm*—Maky, Renner, Otto & Boisselle

[57] ABSTRACT

An electrical connector progressively made from a one piece blank has a reinforced wire barrel, integral strain relief ferrule, and an internal wire ramp therebetween. The reinforced wire barrel includes nested cylindrical walls having side edges contacting opposite surfaces of an offset web extending between and interconnecting the two cylindrical walls.

15 Claims, 14 Drawing Figures

INTEGRAL ELECTRICAL CONNECTOR AND METHOD FOR MAKING SAME

BACKGROUND OF THE INVENTION

The present invention relates to an electrical connector, in general, and to a crimp type electrical connector having a reinforced wire barrel with an offset or webbed seam made from an integral blank, in particular.

One piece connectors having reinforced wire barrels have been used in the electrical terminal art before. For example, one reinforced wire barrel has been formed by folding an elongated section of the barrel portion about a transverse axis to position such section over the main barrel portion to form a double thickness and by then rolling such double thickness into cylindrical shape to form a wire barrel having a longitudinal open seam. Alternatively, two transversely extending wing tabs may initially be folded over the main wire barrel portion to form a double thickness, which may then be rolled into cylindrical shape to form a wire barrel with a longitudinal open seam, as shown in U.S. Pat. No. 4,142,771. The reinforced wire barrel portions of these one piece prior art connectors suffer from common shortcomings.

In this regard, the one piece reinforced wire barrel portions have a longitudinal open seam that does not provide structural strength and integrity and does not provide totally predictable radial contraction during crimping. To alleviate these problems, the open seam may structurally be closed by brazing, but this adds to the cost and time of manufacture while detrimentally reducing the strength of thinner connector materials used for quick disconnect forms. Moreover, these particular open seam reinforced wire barrels do not have integral strain relief ferrules.

SUMMARY OF THE INVENTION

The primary object of the present invention is to provide a relatively inexpensive one piece electrical connector having a reinforced wire barrel portion with an offset web of material extending across the barrel seam.

Another object of the present invention is to provide a one piece connector having a reinforced wire barrel, integral strain relief ferrule, and an internal camming ramp between the barrel and ferrule.

It is yet another object of the present invention to provide uniformity in external diameter for the one piece reinforced wire barrel and strain relief ferrule to permit insulation readily to be placed around the same. In one embodiment of the invention, the ferrule has an elongated shoulder to permit radial expansion of the same after the insulation has been externally applied.

It is still another object of the present invention to provide a manufacturing process for making a one piece connector having a reinforced wire barrel with offset web seam in a progressive forming line without brazing.

These objects are accomplished by utilizing the concept of making the reinforced wire barrel of the present invention from a single piece blank formed to have nested radially inner and outer cylindrical walls interconnected by an offset web extending therebetween. The single piece blank employed in practicing this concept may also be formed (1) to provide a strain relief ferrule integral with and extending beyond the radially outer cylindrical wall of the wire barrel and (2) to provide a chamfered transverse edge on the radially inner wall to form an internal camming ramp.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

DETAILED DESCRIPTION OF THE INVENTION

Figure 1:
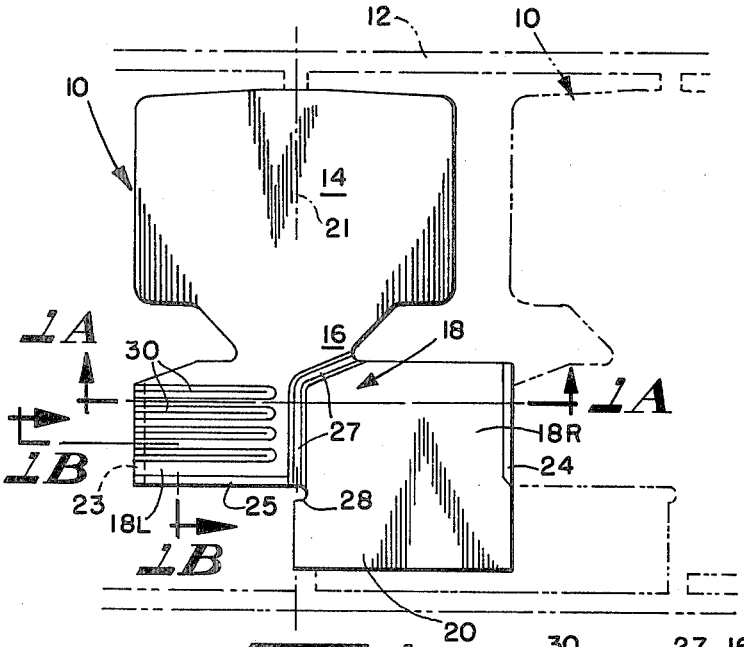
FIG. 1 is a plan view showing a stamped metal blank on a ladder carrier after some initial forming steps have been performed on the blank.
Figure 1B:
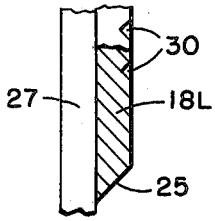
FIG. 1B is a side elevation partially in section along the plane 1B—1B of FIG. 1 showing the V-shape corrugations in one surface of the wire barrel portion and a chamfer on the transfers end edge of such wire barrel portion.
Figure 1A:
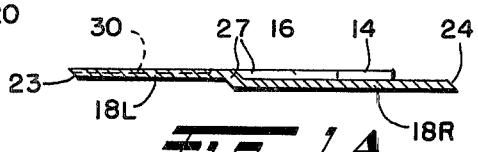
FIG. 1A is a cross-section taken substantially along the plane 1A—1A of FIG. 1 showing the wire barrel portion of said blank with the offset, chamfers and corrugations formed thereon.
Figure 2:
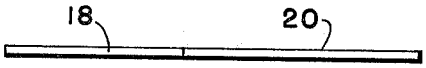
FIGS. 2 through 2E are end views sequentially and schematically showing the progressive formation of the reinforced wire barrel and strain relief ferrule from an initial flat blank station to the mandrel forming station.
Figure 2A:
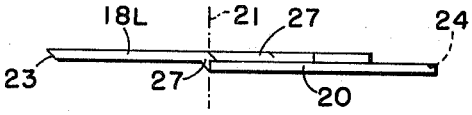

Referring now in more detail to the drawing and initially to FIG. 1, a forming blank indicated generally at 10 is stamped in flat form from strip stock of any suitable conductive alloy material, typically a brass or copper alloy. Preferably, a number of stamped flat blanks 10 are commonly carried by ladder forming strips 12 for ease of handling and progressive processing in well-known manner. The flat blank 10 may include, from back to front, a tongue portion 14, a transition portion 16, a wire barrel portion 18, and a strain relief ferrule portion 20. In the embodiment illustrated in FIGS. 1–3, the tongue portion 14, transition portion 16, and wire barrel portion 18 of the flat blank extend to both sides of a longitudinal forming line 21, whereas the strain relief ferrule portion 20 extends only to one side of said forming line. Several initial forming steps are performed on the blank 10 in its flattened condition, as best illustrated in FIGS. 1A, 2 and 2A.

In this regard, the opposed side edges of the wire barrel portion 18 are oppositely beveled to form generally parallel chamfered surfaces 23 and 24. The foward exposed and transversely extending end edge of the wire barrel portion is also beveled to form a chamfered surface 25. The flat stock of the wire barrel portion is also bent by stamping to form an offset 27, which defines the left and right wire barrel sections, 18L and 18R, respectively. Barrel section 18R is slightly wider than barrel section 18L to permit the offset 27 to become a continuous web at the seam as described in more detail below.

Such offset 27 extends generally along the longitudinally oriented forming line 21 and then extends at an obtuse angle therefrom to the intersection of the transition zone 16 and wire barrel portion 18. The front of the wire barrel portion 18 has a cut-out edge or notch 28 to provide tool relief to permit the offset 27 readily to be formed in the blank. The wire barrel portion 18L may also have a series of parallel V-shape grooves 30 formed in its top surface while in its flattened condition to provide wire gripping corrugations.

The initially formed metal blank is then fed through a progressive forming process line to make the electrical terminal connector of the present invention. The progressive formation of the reinforced wire barrel and strain relief ferrule is emphasized in FIGS. 2 through 2E, since the tongue portion 14 may be formed into any configuration desired, including quick disconnect configurations.

Figure 2B:
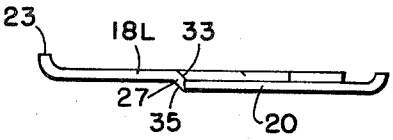
Figure 2C:
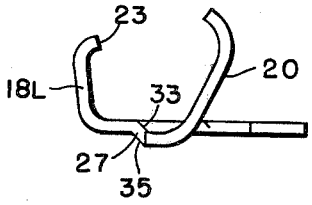

Referring to FIG. 2B, the wire barrel portion section 18L is arcuately bent upwardly in a clockwise direction generally about such forming line 21, whereas the wire barrel portion section 18R and strain relief ferrule portion 20 are simultaneously oppositely arcuately bent about forming line 21 in a generally counterclockwise direction. The blank is sequentially further bent in such manner in progressive stations along the process line through which the blanks are sequentially advanced by the ladder carrying strip as schematically illustrated in FIGS. 2C and 2D.

Figure 2D:
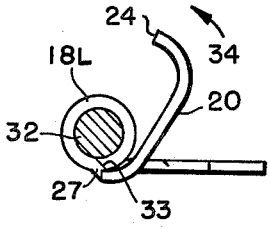
Figure 2E:
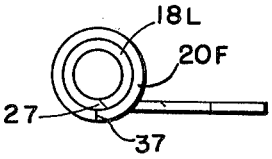

In FIG. 2D, a mandrel station is illustrated in which the wire barrel portion section 18L is intimately wrapped around a mandrel 32 inserted therein. Such mandrel provides a uniform repetitive diameter for the wire barrel portion section 18L thereby to form an inner cylindrical wall of cnsistent diameter for the reinforced wire barrel. The chamfer 23 at the side edge of the wire barrel portion section 18L comes into contact with and preferably matingly abuts against the inclined surface 33 on offset 27. The side edge of wire barrel portion 18L is angled to parallel the bent offset 27 so that the edge 23 generally abuts such offset along its entire extent, preferably in such mated relationship.

The wire barrel portion section 18R and strain relief ferrule portion 20 may be simultaneously progressively bent in succeeding process stations in a counterclockwise direction as indicated by arrow 34 in FIG. 2D. Ultimately, the wire barrel portion section 18R intimately circumferentially engages the wire barrel portion section 18L nested therewithin. In such position, the chamfered side edge surface 24 of wire barrel portion section 18R comes into contact with and preferably matingly abuts the opposite surface 35 of offset 27, as best shown in FIG. 3A.

The thus formed radially inner and outer cylindrical walls 18L and 18R, respectively, have their chamfered side edges 23 and 24 respectively mating with the opposite surfaces 33 and 35 of the offset web 27 extending therebetween to provide smooth and circumferentially offset radially inner and outer seams. Moreover, the offset web seam with butt joints just described for the inner and outer cylindrical walls of the reinforced wire barrel is relatively strong and is generally longitudinally continuous with the butt joint formed in the integral strain relief ferrule.

In this latter regard, the final counterclockwise bending of the wire barrel portion section 18R and strain relief ferrule portion 20 also forms an integral cylindrical strain relief ferrule having a butt joint or seam 37 which is longitudinally aligned with the offset web 27. The outer diameter of the formed reinforced wire barrel (indicated generally at 18F) and integrally formed strain relief ferrule (indicated generally at 20F) is substantially uniform along the entire length of the same to provide a circumferentially continuous outer surface therealong. Such uniformity and continuity permits the reinforced wire barrel 18F and strain relief ferrule 20F to be readily press fit into a sleeve of insulating material 38 if required.

Figure 3:
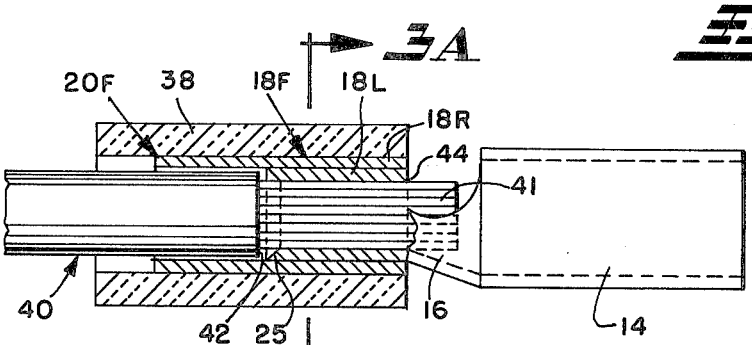
FIG. 3 is a side elevation partially in section of the insulated electrical terminal connector of the present invention having an insulated wire with an exposed end inserted therein prior to crimping.
Figure 3A:
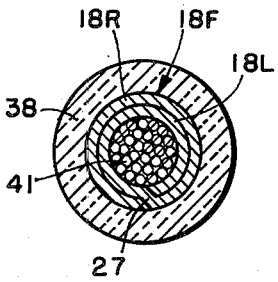
FIG. 3A is a vertical cross-section taken along the plane 3A—3A of FIG. 3 illustrating the finally formed construction of the reinforced and insulated wire barrel.

After the transition portion and tongue have been formed to their desired configuration, the electrical terminal connector formed as described is ready for assembly with an insulated wire member 40, which has the wires or conductive strands 41 at one end thereof exposed by cutting away the insulation sheath 42 in well known manner, as illustrated in FIG. 3. The exposed wires 41 are advanced into the strain relief ferrule 20F with the chamfered transverse end surface 25 of the inner cylindrical wall 18L forming a ramp or funnel to cam the exposed wires into the reinforced wire barrel 18F. With the insulated wire 40 fully inserted to where the insulation 42 abuts the ramp and the wires 41 are passed through the open end 44 of the wire barrel 18F for viewing through the open top of the formed U-shape transition, the wire barrel 18F and strain relief ferrule 20F may be crimped tightly respectively to grip the wires 41 and insulation 42 positioned therewithin. This crimping because of the web or offset 27 at the wire barrel seam has relatively equal radially inwardly directed movements about its circumference and thus tightly and strongly grips such wires about their entire periphery.

Figure 4:
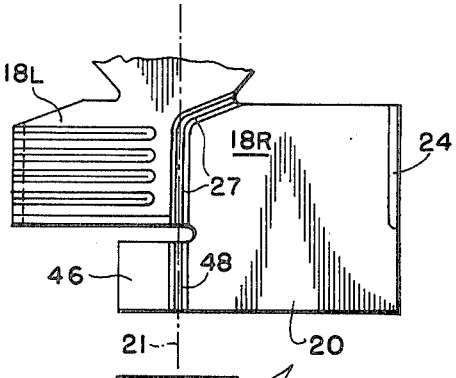
FIG. 4 is a fragmentary plan view of another embodiment of the invention including an expansion shoulder on the strain relief ferrule portion of the blank.

Crimpable connectors are sometimes designed for use with, or field conditions require the use with, more than one diameter of insulated wire. To provide some degree of adaptability, the ferrule portion 20 of the flat blank may be provided with an expansion shoulder 46 extending transversely across the forming line 21, as illustrated in FIG. 4. In initial forming of this embodiment, the offset is also stamped into the ferrule portion 20 of the blank as indicated at 48. The expansion shoulder 46 is arcuately bent about forming line 21 in a clockwise direction during the progressive forming process. The ferrule portion 20 is simultaneously arcuately rolled in an opposite counterclockwise direction to have its end surface abut offset 48 while cradling expansion shoulder 46.

Figure 4A:
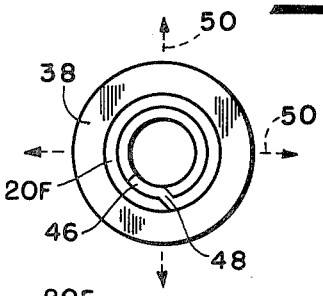
FIG. 4A is an end view of the connector of FIG. 4 in its formed and insulated state prior to radial expansion of the strain relief ferrule.
Figure 4B:
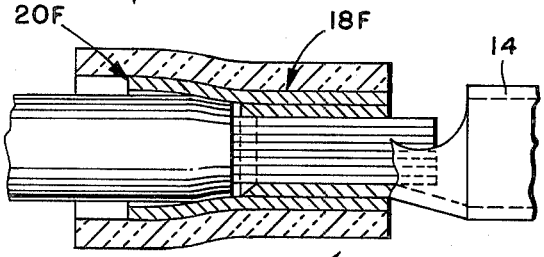
FIG. 4B is a side view, partially in section, of the connector of FIG. 4A after the strain relief ferrule has been radially expanded.

After such formation, an insulation sleeve 38 may be readily applied to the uniform outside diameter of the integrally formed ferrule 20F and barrel 18F. Thereafter, a forming punch may be inserted radially to expand the strain relief ferrule as indicated by arrows 50. The radial expansion is readily accommodated in the ferrule 20F by shoulder 46 moving to the right along its cradle as viewed in FIG. 4A. This permits a wire 40 with thicker insulation, or even a larger diameter wire, to be crimped in the connector of the present invention without a large gap existing in the expanded ferrule at the seam.

Although a terminal connector has been illustrated in the present application, it will be appreciated that the reinforced wire barrel concept disclosed herein may be readily used in wire splices of all types, with quick disconnect terminals, and with tongues of all types. The term connector as used herein is meant to generically define all such electrical wire terminating and joining components.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. An electrical connector made from a one-piece body adapted to terminate or join at least one electrical lead wire having an insulating sheath containing conductor means, said connector comprising connector means adapted for termination or joinder and a reinforced wire barrel having nested radially inner and outer cylindrical walls which have side edges contacting opposite surfaces of an offset web extending between and interconnecting the two cylindrical walls, the reinforced wire barrel being adapted to receive the conductor means of said lead wire for termination or joinder.

2. The electrical connector of claim 1 further comprising an integral strain relief ferrule formed by the radially outer cylindrical wall extending longitudinally beyond the radially inner cylindrical wall.

3. The electrical connector of claim 2 wherein the strain relief ferrule has a shoulder positioned therewithin to permit radial expansion.

4. The electrical connector of claim 2 wherein a transverse end edge of the radially inner cylindrical wall adjacent the strain relief ferrule has a chamfered surface forming an internal diameter funnel leading into the wire barrel from the strain relief ferrule.

5. The electrical connector of claim 1 wherein the longitudinal edges of the radially inner and outer cylindrical walls have beveled surfaces contacting opposite surfaces of the offset web to form circumferentially smooth radially inner and outer offset seams for the wire barrel.

6. The electrical connector of claim 1 wherein said connector means is a tongue joined to a generally U-shape transition member, which in turn is joined to said reinforced wire barrel, with said wire barrel having open ends.

7. The electrical connector of claim 1 wherein the offset web consists of two bends of discrete length in said body merged together at an obtuse angle, and the radially inner cylindrical wall has a side surface configured to complement the two bends of the offset web and beveled to mate with the adjacent surface of said offset web.

8. An electrical connector made from a one-piece body adapted to terminate or join at least one electrical lead wire having an insulating sheath containing conductor means, said connector comprising connector means adapted to join or terminate, a reinforced wire barrel formed by nested and coaxial radially inner and outer cylindrical walls interconnected by an offset bent web, an integral strain relief ferrule formed by said outer cylindrical wall extending longitudinally beyond said radially inner cylindrical wall, and an internal ramp between said wire barrel and strain relief ferrule formed by a chamfered transverse edge on an end of the radially inner cylindrical wall, the internal ramp being adapted to cam the conductor means of the lead wire into the reinforced wire barrel for termination or joinder.

9. The electrical connector of claim 8 wherein side edges of the radially inner and outer cylindrical walls are configured and chamfered to abut against and mate with opposite surfaces on the offset bent web.

10. A method for making an integral electrical connector comprising the steps of forming a flat blank having a connector means portion and a wire barrel portion, with the latter extending on both sides of a longitudinal forming line for said blank, bending the wire barrel portion along at least a part of said forming line to form an offset, and then progressively oppositely bending the sections of the barrel portion lying on opposite sides of said forming line about said forming line finally to form a reinforced wire barrel including nested radially inner and outer cylindrical walls having side edges contacting opposite surfaces of said offset, inserting conductor means of an insulated lead wire into said reinforced wire barrel, and crimping the reinforced wire barrel onto the conductor means.

11. The method of claim 10 wherein the step of forming a flat blank also produces a strain relief ferrule portion connected to and at least coextensive with the wire barrel portion section on the same side of the forming line, the wire barrel portion section and ferrule portion on said one side of said forming line being wider than the wire barrel portion section on the other side of said forming line.

12. The method of claim 11 wherein the progressive forming step includes bending the ferrule portion with said wire barrel portion section to which it is connected respectively finally to form a strain relief ferrule and the outer cylindrical wall of the wire barrel, said ferrule and outer cylindrical wall being continuous and substantially of the same outside diameter.

13. The method of claim 12 including the further step of beveling both side edges of the wire barrel portion in its flat condition to form chamfers thereon that will mate with the opposite surfaces of the offset after the progressive bending step.

14. The method of claim 13 including still the further step of beveling an end edge of the flat wire barrel portion section on said other side of said forming line adjacent the ferrule portion to form a chamfer thereon to act as an internal ramp between the ferrule and wire barrel after the progressive bending step.

15. The method of claim 14 wherein the progressive bending step for the wire barrel portion section on said other side of said forming line includes wrapping the same about a mandrel to form an inner cylindrical wall for said reinforced wire barrel having a substantially uniform diameter.

* * * * *